US011313611B2

(12) United States Patent
Allard et al.

(10) Patent No.: US 11,313,611 B2
(45) Date of Patent: Apr. 26, 2022

(54) CONSTRUCTION METHOD FOR VACUUM INSULATED DOOR

(71) Applicant: WHIRLPOOL CORPORATION, Benton Harbor, MI (US)

(72) Inventors: Paul B. Allard, Coloma, MI (US); Jeffrey Beckner, Niles, MI (US); Kamil EL Sayed, Wroclaw (PL); Lynne F. Hunter, Dorr, MI (US); Sai B. Krishna, Pune (IN); Dustin M. Miller, South Bend, IN (US); Abhay Naik, Stevensville, MI (US); Karen J. Querfurth, Coloma, MI (US); Daniel Lottinville, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/400,093

(22) Filed: May 1, 2019

(65) Prior Publication Data

US 2020/0348072 A1 Nov. 5, 2020

(51) Int. Cl.
*F25D 23/02* (2006.01)
*E04C 2/38* (2006.01)
(Continued)

(52) U.S. Cl.
CPC ..... *F25D 23/02* (2013.01); *F24C 15/02* (2013.01); *F25D 23/028* (2013.01); *F25D 23/04* (2013.01);
(Continued)

(58) Field of Classification Search
CPC ..... F25D 23/02; F25D 23/04; F25D 23/067; F25D 2201/14; F24C 15/02
(Continued)

(56) References Cited

U.S. PATENT DOCUMENTS 1,018,896 A * 2/1912 Frey ..... E06B 3/5892 52/455
1,146,470 A * 7/1915 Anderson ..... F25D 23/082 52/784.15
(Continued)

FOREIGN PATENT DOCUMENTS

DE 3505758 A1 8/1985
EP 1145667 A1 * 10/2001 ..... F25D 23/10
(Continued)

OTHER PUBLICATIONS

Espace.net Translation Koch Hermann DE-3505758-A1 Aug. 1985 https://worldwide.espacenet.com/publicationDetails/biblio?DB=EPODOC&II=0&ND=3&adjacent=true&locale=en_EP&FT=D&date=19850829&CC=DE&NR=3505758A1&KC=A1 (Year: 2020).*

*Primary Examiner* — Brian D Mattei
*Assistant Examiner* — Joseph J. Sadlon
(74) *Attorney, Agent, or Firm* — Price Heneveld LLP

(57) ABSTRACT

A door panel includes an outer panel having a generally planar body portion with inner and outer surfaces and a sidewall with a front edge. An inner panel includes a generally planar body portion with inner and outer surfaces and a sidewall with a front edge. A trim breaker interconnects the outer panel and the inner panel to form a vacuum cavity therebetween. The trim breaker includes first and second upright members interconnected by upper and lower cross members. The trim breaker further includes an inner channel and an outer channel spaced-apart from one another around the trim breaker. The outer channel is outwardly disposed around the inner channel. The front edge of the inner panel is received in the inner channel of the trim breaker, and the front edge of the outer panel is received in the outer channel of the trim breaker.

12 Claims, 12 Drawing Sheets

(51) Int. Cl.
*F25D 25/02* (2006.01)
*F25D 23/06* (2006.01)
*F25D 23/04* (2006.01)
*F24C 15/02* (2006.01)

(52) U.S. Cl.
CPC ..... *F25D 23/067* (2013.01); *F25D 25/02* (2013.01); *F25D 2201/14* (2013.01)

(58) Field of Classification Search
USPC ..... 52/784.15
See application file for complete search history.

(56) References Cited

U.S. PATENT DOCUMENTS 2,625,291 A * 1/1953 Moore ..... F25D 23/082 220/592.08
2,665,456 A 1/1954 Morton
2,745,259 A * 5/1956 Orson ..... F25D 11/022 62/266
2,795,019 A * 6/1957 Royall, Jr. ..... F25D 23/028 49/498.1
3,091,946 A * 6/1963 Kesling ..... B29C 44/1242 62/465
3,218,111 A * 11/1965 Steiner ..... F25D 23/04 312/405.1
3,869,873 A * 3/1975 Thomas ..... F25D 23/082 62/275
4,394,026 A * 7/1983 Kaiser ..... E04C 2/292 277/642
4,732,432 A * 3/1988 Keil ..... F25D 23/082 220/592.06
4,884,415 A * 12/1989 Mandel ..... F25D 21/04 62/277
4,941,289 A * 7/1990 Rolek ..... F25D 23/082 49/504
5,306,082 A * 4/1994 Karlin ..... B29C 49/18 312/405
5,359,795 A * 11/1994 Mawby ..... B29C 44/12 40/405
5,454,997 A * 10/1995 Karlin ..... B29C 49/18 264/163
5,520,453 A 5/1996 Aoki et al.
5,584,551 A * 12/1996 Jenkins ..... F25D 23/082 220/592.08
5,839,252 A * 11/1998 Berghorn ..... E06B 3/822 52/784.13
6,109,712 A * 8/2000 Haworth ..... F24C 15/34 312/400
6,408,841 B1 * 6/2002 Hirath ..... F25D 23/062 126/19 R
6,464,312 B1 * 10/2002 Tenhundfeld ..... E06B 3/822 52/784.13
7,008,032 B2 * 3/2006 Chekal ..... F25D 11/02 312/405
7,210,308 B2 5/2007 Tanimoto et al.
7,421,828 B2 * 9/2008 Reynolds ..... E04B 1/161 52/319
7,449,227 B2 * 11/2008 Echigoya ..... F16L 59/065 428/69
7,886,500 B2 * 2/2011 Leimkuehler ..... F25D 23/02 52/784.1
7,886,559 B2 2/2011 Hell et al.
8,083,985 B2 12/2011 Luisi et al.
8,171,700 B2 * 5/2012 Barnes ..... B21D 47/00 52/745.15
8,283,023 B2 * 10/2012 Mott ..... E06B 3/66342 428/182
8,871,323 B2 10/2014 Kim et al.
8,943,770 B2 * 2/2015 Sanders ..... F16B 5/00 52/282.3
9,170,046 B2 10/2015 Jung et al.
9,175,902 B2 * 11/2015 Oh ..... E05D 7/00
9,476,633 B2 * 10/2016 Allard ..... B32B 3/04
9,518,777 B2 * 12/2016 Lee ..... F25D 23/00
9,885,202 B2 2/2018 Laible
10,018,406 B2 * 7/2018 Liu ..... B32B 1/00
10,161,669 B2 * 12/2018 Naik ..... F25D 23/028
10,429,125 B2 * 10/2019 Deka ..... F25D 23/062
10,563,911 B2 * 2/2020 Grant ..... A47B 51/00
2011/0146335 A1 6/2011 Jung et al.
2014/0346942 A1 11/2014 Kim et al.
2018/0216872 A1 * 8/2018 Jung ..... F25D 23/085
2018/0311884 A1 11/2018 Allard et al.

FOREIGN PATENT DOCUMENTS

EP 2936012 A1 10/2015
EP 2952838 A1 12/2015
GB 1493362 A 11/1977
WO 2017023088 A1 2/2017
WO 2017192121 A1 11/2017
WO 2018063182 A1 4/2018
WO 2018070996 A1 4/2018
WO 2018151704 A1 8/2018

* cited by examiner

CONSTRUCTION METHOD FOR VACUUM INSULATED DOOR

BACKGROUND

The present device generally relates to a vacuum insulated door panel, and more specifically, to a vacuum insulated door panel having a trim breaker with molded-in features for engaging a wrapper, a liner and multiple bin assemblies.

SUMMARY

In at least one aspect, a door panel includes an outer panel having a generally planar body portion with inner and outer surfaces and a sidewall with a front edge. The sidewall of the outer panel inwardly extends from the inner surface of the body portion of the outer panel. An inner panel includes a generally planar body portion with inner and outer surfaces and a sidewall with a front edge. The sidewall of the inner panel inwardly extends from the inner surface of the body portion of the inner panel. A trim breaker interconnects the outer panel and the inner panel to form a vacuum cavity therebetween. The trim breaker includes first and second upright members interconnected by upper and lower cross members. The trim breaker further includes an inner channel and an outer channel spaced-apart from one another around the trim breaker. The outer channel is outwardly disposed around the inner channel. The front edge of the inner panel is received in the inner channel of the trim breaker, and the front edge of the outer panel is received in the outer channel of the trim breaker.

In at least another aspect, a door panel includes an outer panel having a body portion with a sidewall that extends inwardly from the body portion of the outer panel. An inner panel includes a body portion with a sidewall that extends inwardly from the body portion of the inner panel. A trim breaker interconnects the outer panel and the inner panel to form a vacuum cavity therebetween. The trim breaker includes a frame assembly that surrounds an open window, and further includes an inner channel and an outer channel spaced-apart from one another around the frame assembly of the trim breaker. A portion of the sidewall of the inner panel is received in the inner channel of the trim breaker, and a portion of the sidewall of the outer panel is received in the outer channel of the trim breaker.

In at least another aspect, a door panel includes an outer panel having a body portion with a sidewall that extends inwardly from the body portion of the outer panel. An inner panel includes a body portion with a sidewall that extends inwardly from the body portion of the inner panel. A trim breaker interconnects the outer panel and the inner panel to form a vacuum cavity therebetween. The trim breaker includes first and second upright members interconnected by upper and lower cross members, and further includes an inner channel and an outer channel spaced-apart from one another. A portion of the sidewall of the inner panel is received in the inner channel of the trim breaker, and a portion of the sidewall of the outer panel is received in the outer channel of the trim breaker. Each of the first and second upright members further include a plurality of engagement features disposed along an inside surface of the trim breaker.

These and other features, advantages, and objects of the present device will be further understood and appreciated by those skilled in the art upon studying the following specification, claims, and appended drawings.

DETAILED DESCRIPTION OF EMBODIMENTS

Figure 1:
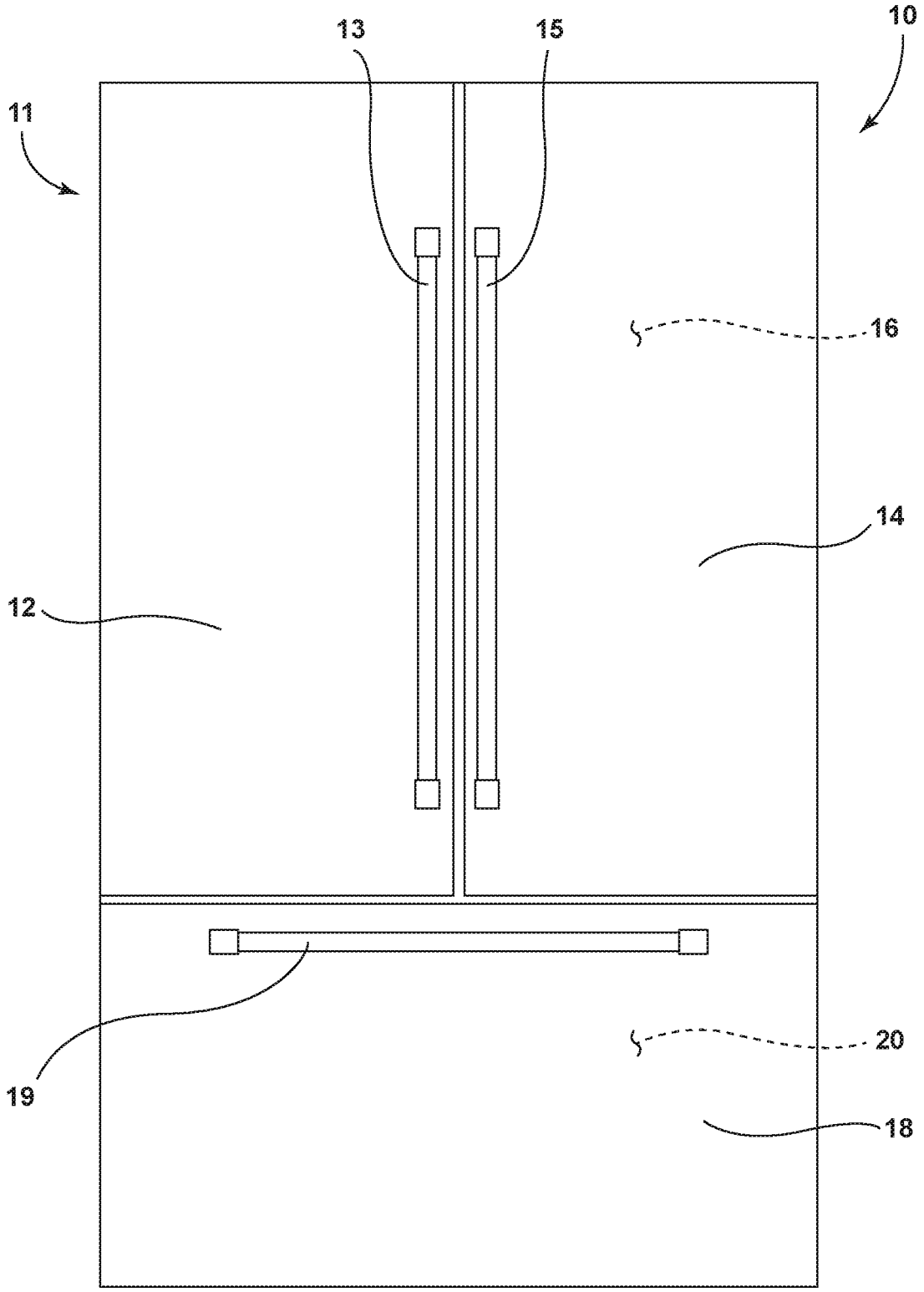
FIG. 1 is a front plan view of a refrigerator having multiple doors.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates an appliance shown in the form of a refrigerator that includes a vacuum insulated cabinet structure 11. The refrigerator 10 further includes first and second doors 12, 14 that are disposed in a French-style door configuration and are pivotally coupled to the vacuum insulated cabinet structure 11 for selectively providing access to a refrigerator compartment 16. The refrigerator 10 shown in FIG. 1 also includes a lower pull-out freezer drawer 18 having a handle 19 that selectively provides access to a freezer compartment 20. It will generally be understood that the features, as set forth herein, could be applied to any appliance having any general configuration. Further, the door configuration of the refrigerator 10 can vary from that shown in FIG. 1 to include a single door or multiple doors in other configurations. The first and second doors 12, 14 illustrated in FIG. 1 include handles 13, 15, respectively, which are configured to allow a user to selectively move the first and second doors 12, 14 between open and closed positions, either separately or together. The first and second doors 12, 14 and the freezer drawer 18 are also contemplated to be vacuum insulated structures, as further described below.

Figure 2B:
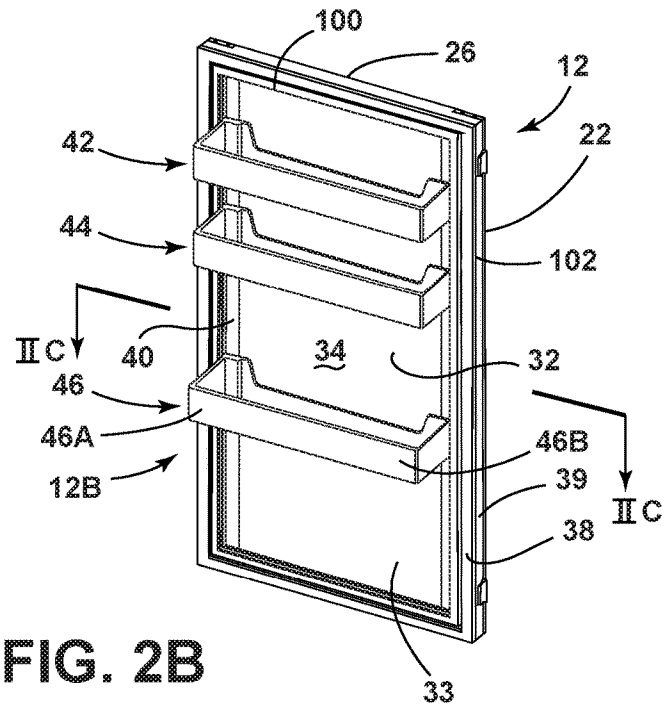
FIG. 2B is a rear top perspective view of the door panel of FIG. 2A.
Figure 2A:
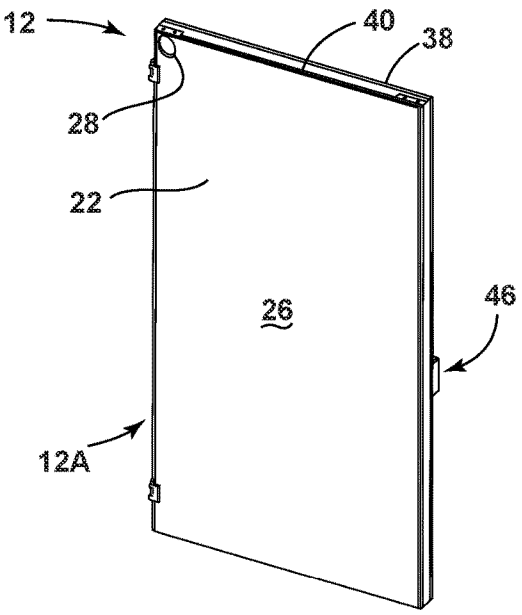
FIG. 2A is a front top perspective view of a door panel for the refrigerator shown in FIG. 1.

Referring now to FIG. 2A, the first door 12 is shown with an outer skin removed therefrom. The first door 12 is exemplary of a door panel for use with the present concept. As such, the description herein of the first door 12 will also generally describe the second door 14 and the freezer drawer 18 shown in FIG. 1. As represented in FIG. 2A, the first door 12 represents a door panel, and will be referred to as such throughout the remainder of this disclosure. As specifically shown in FIG. 2A, the door panel 12 includes an outer panel 22 having a generally planar body portion 23 with an inner surface 24 (FIG. 2C) and an outer surface 26. The outer panel 22 may include an access aperture 28 disposed therethrough which can be used to fill the door panel 12 with an insulating material, and may also be used as an evacuation port to draw a vacuum on the door panel 12. The outer surface 26 of the outer panel 22 defines an exterior side 12A of the door panel 12 as assembled.

Figure 2C:
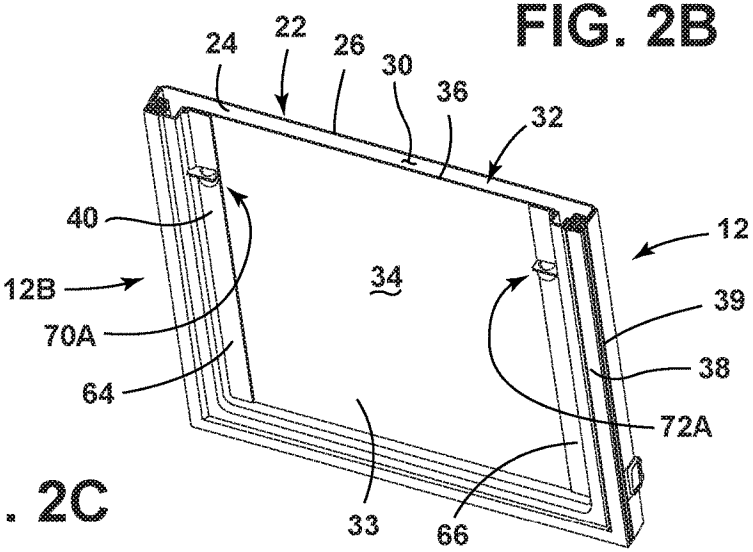
FIG. 2C is a cross-sectional view of the door panel of FIG. 2B taken at line IIA.
Figure 5:
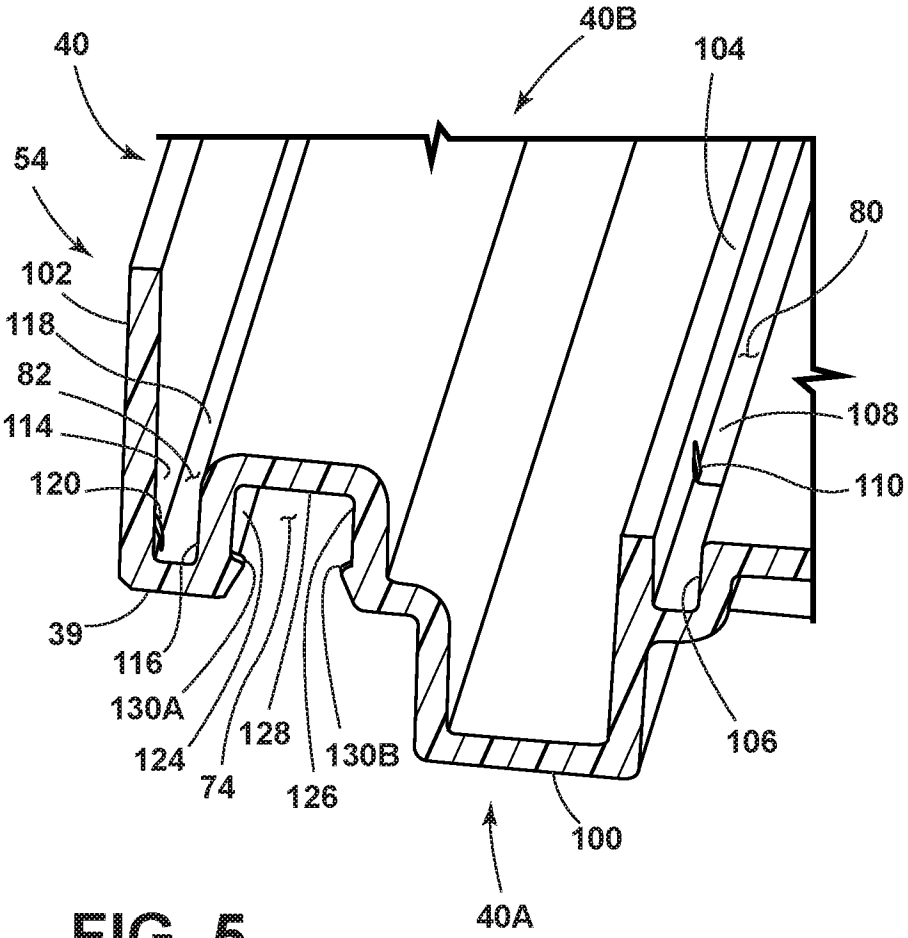
FIG. 5 is a cross-sectional front top perspective view the trim breaker of FIG. 3A taken at line V.

Referring now to FIG. 2B, the door panel 12 further includes an interior side 12B comprising an inner panel 32. The inner panel 32, like the outer panel 22, includes a generally planar body portion 33 having an inner surface 34 and an outer surface 36 (FIGS. 2C, 5). On the interior side 12B of the door panel 12, a gasket assembly 38 is shown disposed around an interior perimeter 39 of the door panel 12. The gasket assembly 38 is contemplated to be a flexibly resilient member, and may be comprised of a polymeric or foam material capable of forming a seal. In use, the gasket assembly 38 is used to seal the door panel 12 to a front surface of the refrigerator compartment 16 when the door panel 12 is in a closed position, as shown in FIG. 1. The outer panel 22 and the inner panel 32 are contemplated to be comprised of metal materials (e.g., stainless steel, carbon steel sheet-metal materials) that are substantially rigid and configured to hold their shape against the forces of a vacuum drawn therebetween.

As shown in FIGS. 2A-2C, the outer panel 22 and the inner panel 32 are interconnected by a trim breaker 40 to form a vacuum cavity 30 therebetween. The trim breaker 40 is contemplated to be a polymeric member formed from a suitable material that is substantially impervious to gasses to maintain a vacuum in the vacuum cavity 30 defined between the outer panel 22 and the inner panel 32 as interconnected by the trim breaker 40. The material composition of the trim breaker 40 is also contemplated to include a low coefficient of thermal conductivity to reduce or prevent transfer of heat between the metal outer panel 22 and the metal inner panel 32. For use with the present concept, the trim breaker 40 is preferably formed utilizing a polymeric material in an injection molding process. Other materials suitable to form the trim breaker 40 may include, but are not limited to, polyureas, polyisocyanurates, polyesters, polyphenols, polyepoxides, thermoplastic elastomers, polycarbonate, and nylon materials. It is further contemplated that the trim breaker 40 may be overmolded to the outer panel 22 and the inner panel 32 at perimeter edges thereof. In an overmolded construction, the door panel 12 can be a unitary part after the trim breaker 40 is cast onto the perimeter edges of the outer panel 22 and the inner panel 32. Further, it is contemplated that portions of the inner panel 32 and the outer panel 22 can be coupled to coupling features of the trim breaker 40 and retained therein using an adhesive as further described below.

The vacuum cavity 30 is configured to receive an insulating material that may be described as a vacuum core material. The vacuum core material may comprise a plurality of individual core panels that are preformed and positioned between the outer panel 22, the inner panel 32 and the trim breaker 40. Alternatively, the vacuum core material may comprise a silica powder or other suitable loose filler material that is inserted (e.g. blown) into the vacuum cavity 30, after the outer panel 22 and the inner panel 32 are interconnected by the trim breaker 40. The core material may be inserted through access aperture 28 of the outer panel 22, which opens into the vacuum cavity 30.

With specific reference to FIG. 2B, a plurality of bin assemblies 42, 44 and 46 are shown disposed on the interior side 12B of the door panel 12. Specifically, the bin assemblies 42, 44 and 46 are configured to be removeably coupled to the trim breaker 40 as further described below. The bin assemblies 42, 44 and 46 are reconfigurable along the trim breaker 40 and may include a variety of size profiles and features. With specific reference to bin assembly 46, the bin assembly 46 includes opposed first and second sides 46A, 46B which are coupled to opposing upright members of the trim breaker 40, as further described below.

With specific reference to FIG. 2C, the vacuum cavity 30 of the door panel 12 is shown as defined between the outer panel 22, the inner panel 32 and the trim breaker 40 of the door panel 12. The trim breaker 40 is contemplated to engage the outer panel 22 and the inner panel 32 in a sealed manner so as to create an airtight cavity within the vacuum cavity 30. In this way, the door panel 12 is capable of having a vacuum drawn within the vacuum cavity 30, and maintaining the vacuum given the sealed connections between the trim breaker 40, the outer panel 22 and the inner panel 32. The sealed interconnection between the trim breaker 40, the outer panel 22 and the inner panel 32 are further described below. Further, the vacuum is maintained within the vacuum cavity 30 of the door panel 12 in part by the sheet metal materials of the inner and outer panels 32, 22 and the gas impervious polymeric materials of the trim breaker 40. The vacuum cavity 30 defined between the outer panel 22, the inner panel 32 and the trim breaker 40 may have an air pressure level of less than about 1 atm, about 0.5 atm, about 0.4 atm, about 0.3 atm, about 0.2 atm, about 0.1 atm, about 0.01 atm, or less than about 0.001 atm.

Figure 3B:
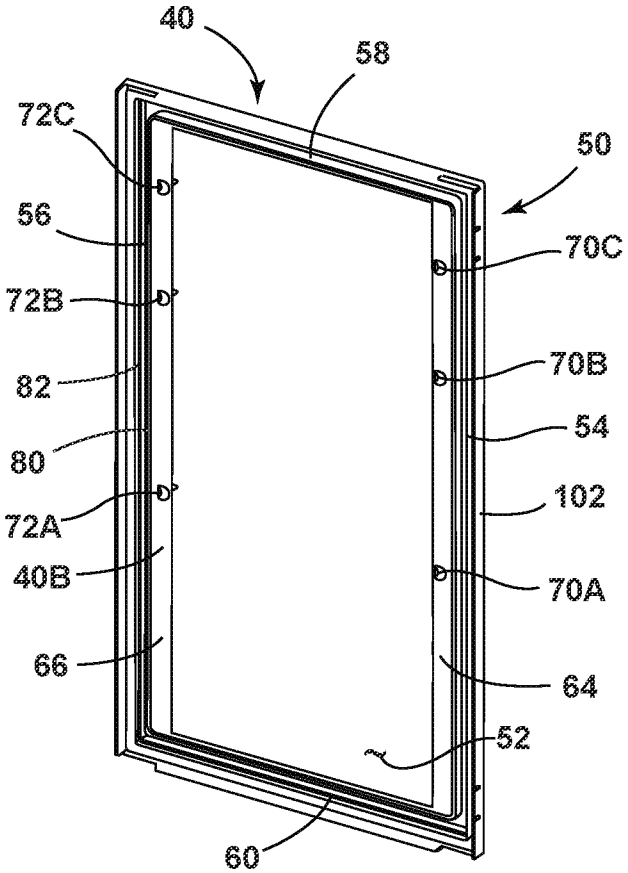
FIG. 3B is a rear top perspective view of the trim breaker of FIG. 3A.
Figure 3A:
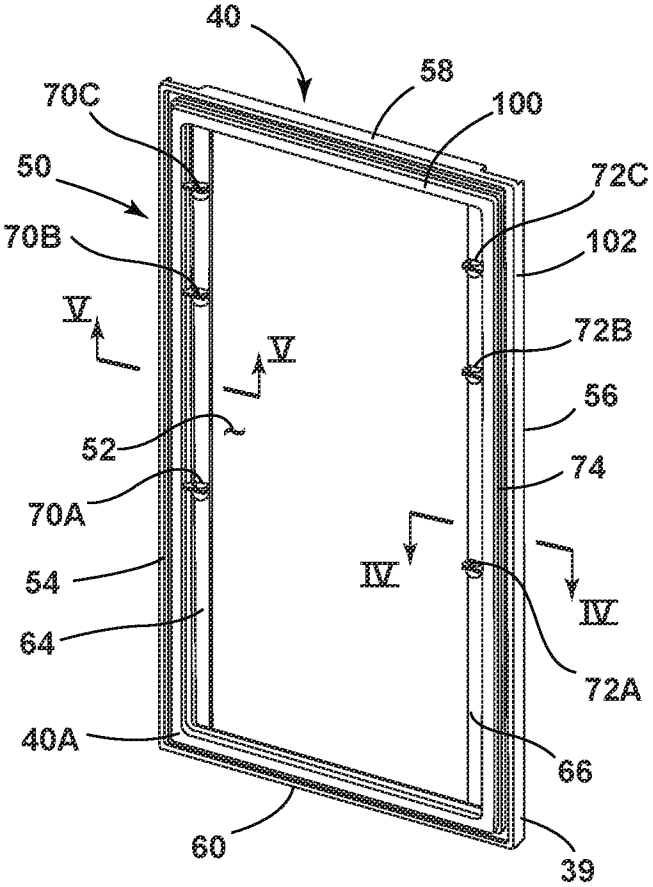
FIG. 3A is a front top perspective view of a trim breaker.

Referring now to FIG. 3A, the trim breaker 40 is shown having a frame assembly 50 surrounding an open window 52. The frame assembly 50 of the trim breaker 40 is defined by first and second upright members 54, 56 which are spaced-apart from one another and interconnected by upper and lower cross members 58, 60. The first and second upright members 54, 56 and upper and lower cross members 58, 60 are interconnected, such that the trim breaker 40 is a unitary member having a front surface 40A and a rear surface 40B (FIG. 3B). As noted above, the trim breaker 40 is contemplated to be comprised of a polymeric material formed in an injection molding process. The first and second upright members 54, 56 of the trim breaker 40 include inside surfaces 64, 66, respectively. As shown in FIG. 2C, the inside surfaces 64, 66 of the trim breaker 40 are exposed on the inner portion 12B of the door panel 12 when the door panel 12 is in the assembled condition. As further shown in FIG. 3A, the inside surfaces 64, 66 include a number of engagement features disposed thereon which are aligned with one another for supporting the bin assemblies 42, 44, 46 (FIG. 2B). Specifically, inside surface 64 of the first upright member 54 of the trim breaker 40 includes engagement features 70A, 70B and 70C arranged in an ascending order along a length of the first upright member 54. Similarly, inside surface 66 of the second upright member 56 of the trim breaker 40 includes engagement features 72A, 72B and 72C arranged in an ascending order along a length of the second upright member 56. As shown in FIG. 3A, engagement features 70A, 70B and 70C of the first upright member 54 are aligned with engagement features 72A, 72B and 72C of the second upright member 56. In this way, the engagement features 70A, 70B, 70C and 72A, 72B, 72C support the bin assemblies 42, 44 and 46 at opposite ends of the bin assemblies 42, 44 and 46 at varying vertical positions. It is contemplated that the bin assemblies 42, 44 and 46 are removeably coupled to the engagement features 70A, 70B, 70C and 72A, 72B, 72C, such that the bin assemblies 42, 44 and 46 can easily be removed and rearranged by a user.

As further shown in FIG. 3A, a forwardly opening channel 74 is disposed around the perimeter 39 of the trim breaker 40. In use, the forwardly opening channel 74 is configured to receive the gasket assembly 38, as further described below with reference to FIG. 7B. The forwardly opening channel 74 of the trim breaker 40 is a continuous channel positioned around the entire perimeter 39 of the trim breaker 40 along the first and second upright members 54, 56, as well as the upper and lower cross members 58, 60. In this way, the forwardly opening channel 74 is continuously disposed around the entirety of the frame assembly 50 of the trim breaker 40 to provide a complete seal for the door panel 12 to the refrigerator compartment 16 when the gasket assembly 38 is received therein.

Referring now to FIG. 3B, the trim breaker 40 is shown a rear surface 40B thereof. In FIG. 3B, the trim breaker 40 is shown as having an inner channel 80 and an outer channel 82 spaced-apart from one another. Both the inner channel 80 and the outer channel 82 are rearwardly opening channels that are configured to receive front edges of the inner panel 32 and outer panel 22, respectively. The interconnection of the inner panel 32 and outer panel 22 with the inner channel 80 and the outer channel 82 is best shown in FIG. 7B. In FIG. 3B, the inner channel 80 and the outer channel 82 are continuously disposed around the entirety of the frame assembly 50 of the trim breaker 40 along the first and second upright members 54, 56, as well as the upper and lower cross members 58, 60. In this way, the interconnection between trim breaker 40 and the inner panel 32 and outer panel 22 is complete around the entire perimeter 39 of the trim breaker 40 for providing a sealed vacuum cavity 30 therebetween. As further shown in FIG. 3B, the outer channel 82 surrounds the inner channel 80, such that the outer channel 82 is disposed outwardly around the inner channel 80. Specifically, the outer channel 82 is disposed adjacent to the perimeter 39 of the trim breaker 40, while the inner channel 80 is inset from the perimeter 39 of the trim breaker 40.

Figure 4:
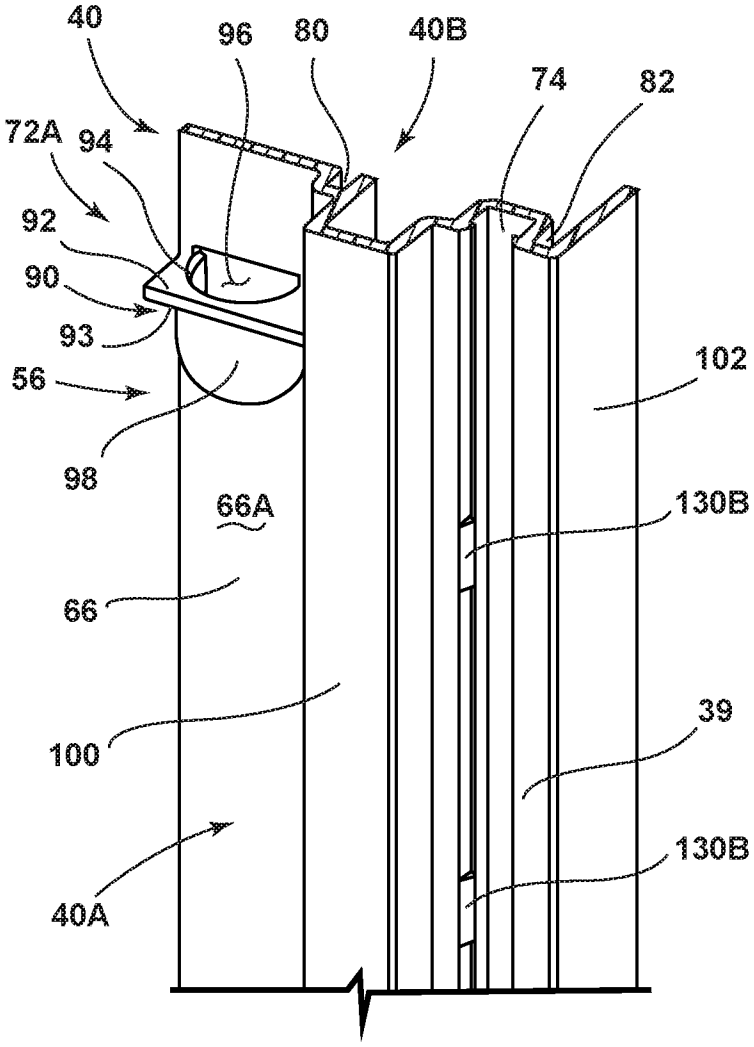
FIG. 4 is a cross-sectional front top perspective view the trim breaker of FIG. 3A taken at line IV.

Referring now to FIG. 4, a cross-sectional view of the second upright 56 of the trim breaker 40 is provided to better exemplify the contours of the trim breaker 40. The cross-sectional view of the second upright 56 exemplifies the features that are also found on the first upright 54 and the upper and lower cross members 58, 60. On the inside surface 66 of the second upright 56, engagement features 72A is shown. Engagement feature 72A is exemplary of the engagement features 70A-70C and 72B-72C, such that the description of engagement features 72A also applies to the corresponding engagement features 70A-70C and 72B-72C disposed on the trim breaker 40. As shown in FIG. 4, the engagement feature 72A includes a tab 90 outwardly extending from a front surface 66A of the inside surface 66. The tab 90 includes an upper surface 92 that serves as an abutment surface for a corresponding portion of a bin assembly, such as bin assembly 46 shown in FIG. 2B, when the bin assembly is coupled to engagement feature 72A. The tab 90 further includes an undersurface 93. An aperture 94 is disposed through the tab 90 and opens into a cavity 96 which is generally defined by a shell 98 disposed below and extending downwardly from the undersurface 93 of the tab 90. In use, the cavity 96 is configured to receive a mounting feature of a bin assembly, such as bin assembly 46 (FIG. 2B), for removeably mounting the bin assembly to the trim breaker 40.

As further shown in FIG. 4, the inner channel 80 of the trim breaker 40 is a rearwardly opening channel disposed along the inside surface 66. Being a rearwardly opening channel, the inner channel 80 of the trim breaker 40 is accessible to receive a portion of the inner panel 32 of the door panel 12 from the rear surface 40B of the trim breaker 40. The inner channel 80 of the trim breaker 40 is a generally U-shaped channel having specific contours further described below with reference to FIG. 5. Positioned outwardly from the inner channel 80, a forwardly extending frontmost surface 100 is disposed in a generally central position along the second upright 56 of the trim breaker 40. In the assembled door panel 12 (FIG. 2B), the frontmost surface 100 of the trim breaker 40 is shown positioned around the entirety of the door panel 12.

As further shown in FIG. 4, the forwardly opening channel 74 of the trim breaker 40 is shown opening in a forward direction and having a generally U-shaped configuration as further described below with reference to FIG. 5. By opening in a forward direction, the forwardly opening channel 74 is accessible from the interior side 12B of the door panel 12 for receiving the gasket assembly 38 therein, as further described below with reference to FIG. 7B. The forwardly opening channel 74 is disposed outwardly of the frontmost surface 70 of the trim breaker 40.

Disposed outwardly of the forwardly opening channel 74, the outer channel 82 is disposed. The outer channel 82 of the trim breaker 40 is a generally U-shaped channel having specific contours further described below with reference to FIG. 5. As shown in FIG. 4, the outer channel 82 is a rearwardly opening channel. Being a rearwardly opening channel, the outer channel 82 of the trim breaker 40 is accessible to receive a portion of the outer panel 22 of the door panel 12 from the rear surface 40B of the trim breaker 40. The trim breaker 40 includes an outermost surface 102 which provides a clean look for the assembled door panel 12 between the gasket assembly 38 and the outer panel 22, as best shown in FIG. 7B.

Referring now to FIG. 5, the inner channel 80 includes first and second sidewalls 104, 106 which are interconnected by an end wall 108 to define the U-shaped configuration of the inner channel 80. As further shown in FIG. 5, a centering feature 110 is shown in the form of a ramped flange extending inwardly from the first sidewall 104 into the inner channel 80. It is contemplated that the centering feature 110 can also be disposed along the second sidewall 106 of the inner channel 80. Thus, the inner channel 80 may include multiple centering features 110 that are used to help center a portion of the inner panel 32 as received in the inner channel 80, as further described below with reference to FIG. 7B.

With further reference to FIG. 5, the outer channel 82 includes first and second sidewalls 114, 116 which are interconnected by an end wall 118 to define the U-shaped configuration of the outer channel 82. As further shown in FIG. 5, a centering feature 120 is shown in the form of a ramped flange extending inwardly from the first sidewall 114 into the outer channel 82. It is contemplated that the centering feature 120 can also be disposed along the second sidewall 116 of the outer channel 82. Thus, the outer channel 82, much like the inner channel 80, may include multiple centering features 120 that are used to help center a portion of the outer panel 22 as received in the outer channel 82, as further described below with reference to FIG. 7B.

With further reference to FIG. 5, the forwardly opening channel 74 includes first and second sidewalls 124, 126 which are interconnected by an end wall 128 to define the U-shaped configuration of the forwardly opening channel 74. As further shown in FIG. 5, an engagement feature 130A is shown in the form of a ramped flange or barb extending inwardly from the first sidewall 124 into the forwardly opening channel 74. Another engagement feature 130B is shown inwardly extending from the second sidewall 126 of the forwardly opening channel 74. Forwardly opening channel 74 is contemplated to include multiple engagement features, such as engagement features 130A, 130B, that are used securely engage the gasket assembly 38 within the forwardly opening channel 74, as further described below with reference to FIG. 7B. It is further contemplated that the engagement features 130A, 130B may run the length of the first and second sidewalls 124, 126 to ensure that the gasket assembly is securely engage along the entire length of the forwardly opening channel 74.

Figure 6:
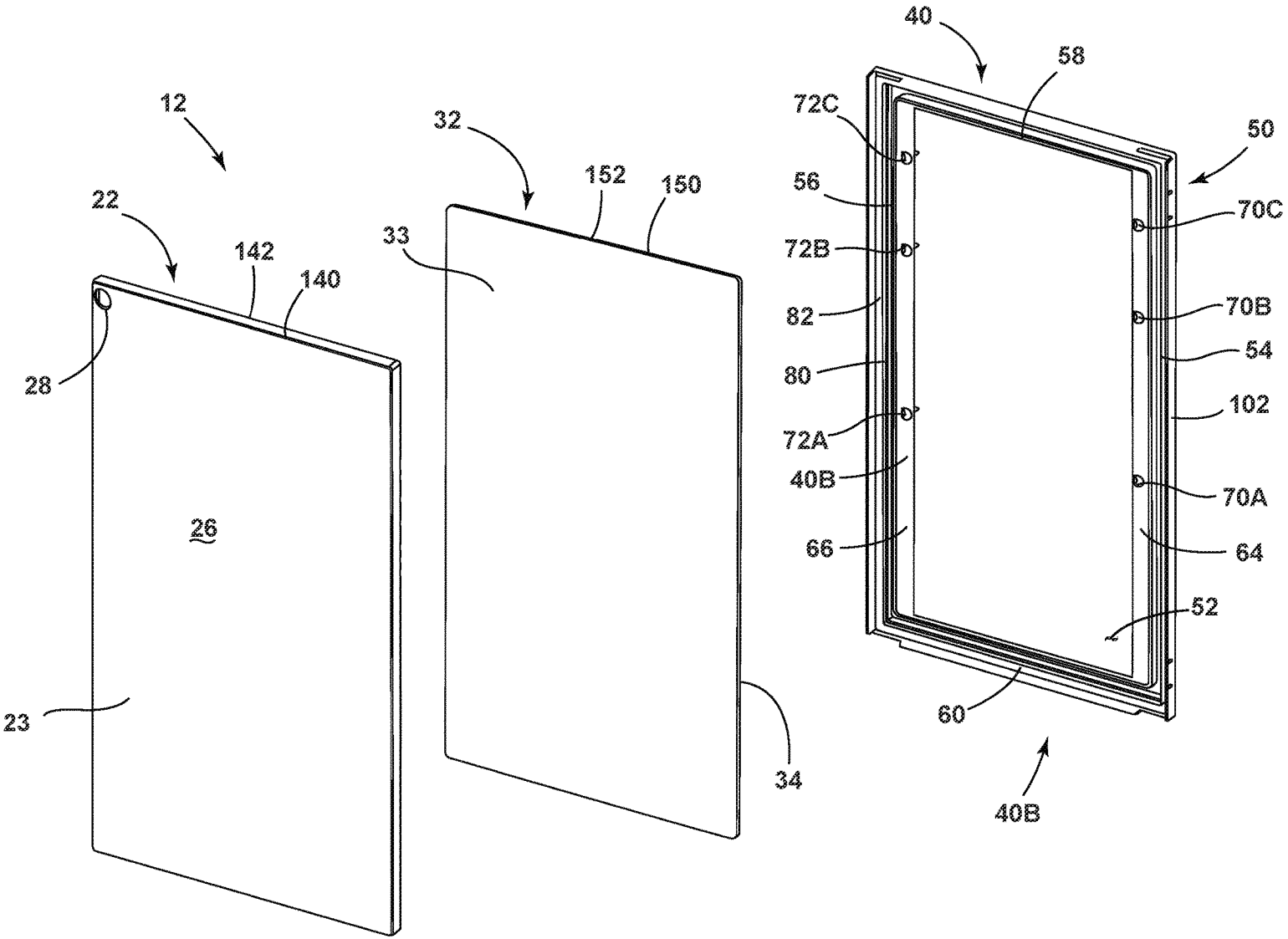
FIG. 6 is an exploded top perspective view of the door panel of FIG. 2A.

Referring now to FIG. 6, and exploded view of the door panel 12 is shown, wherein the outer panel 22 and inner panel 32 are exploded away from the trim breaker 40. As shown in FIG. 6, the outer panel 22 includes a sidewall 140 extending outwardly from the generally planar body portion 23 of the outer panel 22 along a periphery thereof. The sidewall 140 of the outer panel 22 includes a front edge 142 which is configured to be received in the outer channel 82 of the trim breaker 40, as shown in FIG. 7B. Similarly, the inner panel 32 includes a sidewall 150 extending outwardly from the generally planar body portion 33 of the inner panel 32 along a periphery thereof. The sidewall 150 of the inner panel 32 includes a front edge 152 which is configured to be received in the inner channel 80 of the trim breaker 40, as shown in FIG. 7B. The sidewalls 140, 150 of the outer and inner panels 22, 32, respectively, are contemplated to be disposed around the entire periphery of the body portions 23, 33 of the respective outer and inner panels 22, 32.

Figure 7A:
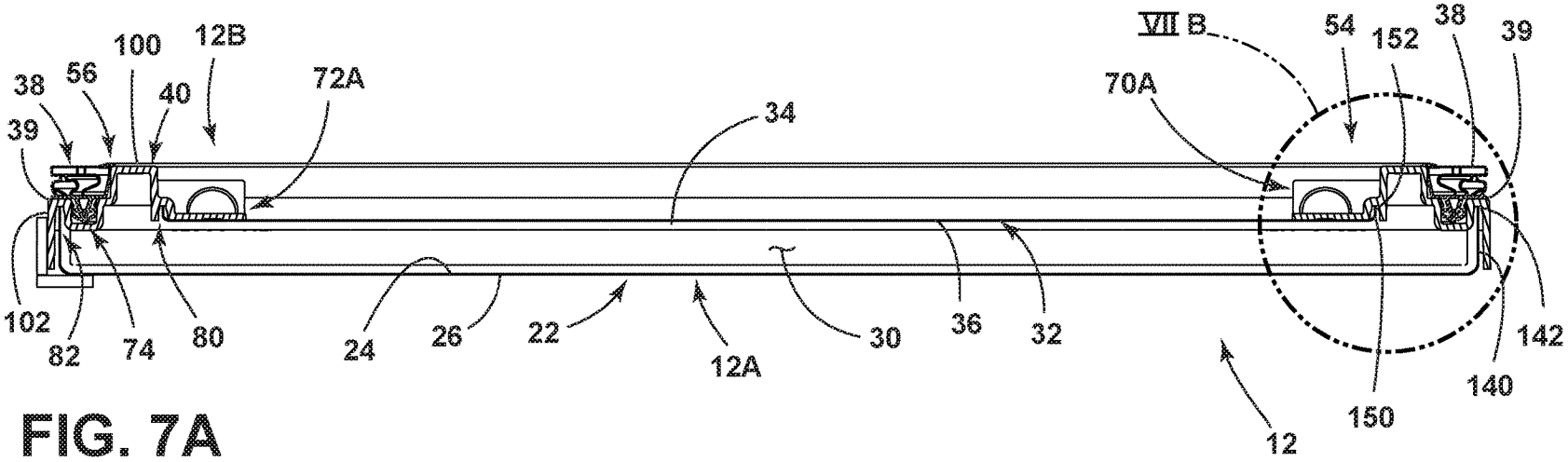
FIG. 7A is a top plan view of the cross-sectional view of the door panel of FIG. 2C.
Figure 7B:
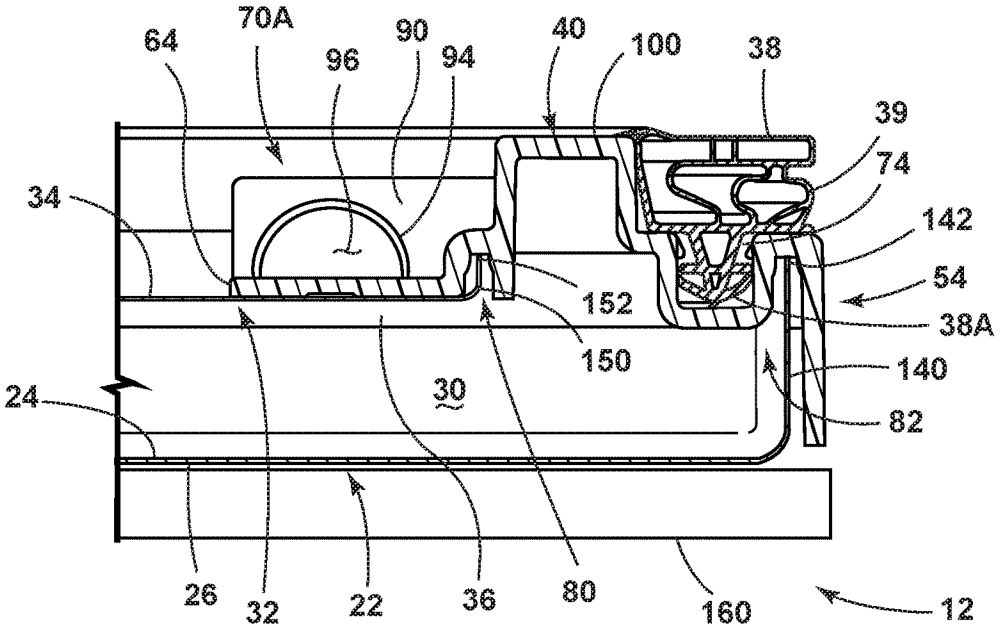
FIG. 7B is a close up view of the door panel of FIG. 7A taken at location VIIB.

Referring now to FIG. 7A, the outer panel 22 and inner panel 32 are shown coupled to the trim breaker 40 to define the vacuum cavity 30 therebetween. Specifically, the outer panel 22 is coupled to the first and second uprights 54, 56 at the outer channels 82 thereof. Similarly, the inner panel 32 is coupled to the inner channels 80 of the first and second uprights 54, 56. In this way, the inner panel 32 is contemplated to be coupled to the inner channels 80 of the trim breaker 40, and then the outer panel 22 is coupled to the trim breaker 40 at the outer channels 82 thereof, to cover the inner panel 32. As specifically shown in FIG. 7B, the front edge 142 of sidewall 140 of the outer panel 22 is received within the outer channel 82 of the trim breaker 40. Similarly, the front edge 152 of the sidewall 150 of the inner panel 32 is received within the inner channel 80 of the trim breaker 40. As received within the inner and outer channels 80, 82, the front edges 152, 142 of the sidewalls 150, 140 of the inner panel 32 and the outer panel 22, respectively, are further contemplated to receive an adhesive within the inner and outer channels 80, 82 to adhere the inner and outer panels 32, 22 to the trim breaker 40 in an airtight manner such that the vacuum cavity 30 can be formed therebetween.

As further shown in FIG. 7B, the gasket assembly 38 is received within the forwardly opening channel 74 at a stem portion 38A thereof. In FIG. 7B, a decorative outer skin 160 is shown disposed on the outer surface 26 of the outer panel 22 and may include a cabinet front, such that the door panel 12 may include a similar look to the surrounding cabinetry when disposed in a kitchen environment. The outer channel 82 and the inner channel 80 of the trim breaker 40 are sized to accept an adhesive and function as a "glue groove." Glue grooves are configured to accept a portion of the respective sidewalls 140, 150 within the inner channel 80 and outer channel 82 along with the applied adhesive (i.e. glue) to form an air tight seal for the vacuum cavity 30 between the outer panel 22, inner panel 32 and the trim breaker 40.

Figure 8A:
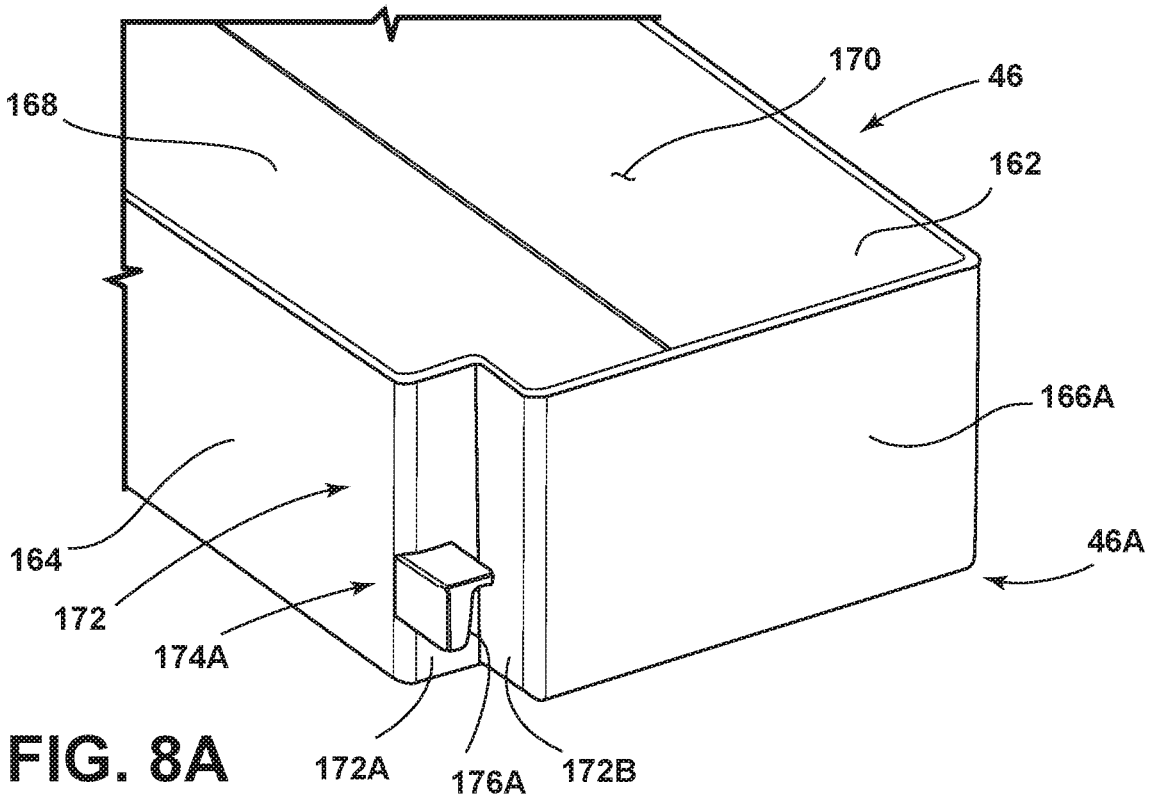
FIG. 8A is a fragmentary top perspective view of a first side of a bin assembly.

Referring now to FIG. 8A, the first side 46A of the bin assembly 46 is shown. As noted above, the bin assembly 46 is configured to interconnect the first and second uprights 54, 56 of the trim breaker 40, as shown in FIG. 2B. In FIG. 8A, the bin assembly 46 is shown to include a front wall 162, a rear wall 164, sidewall 166A, 166B (FIG. 8B), and a bottom wall 168 which cooperate to define a storage compartment 170. As coupled to the trim breaker 40, the bin assembly 46 is contemplated to store items to be refrigerated on the door panel 12. As noted above, the bin assembly 46 is removably coupled to the trim breaker 40 and can be mounted along any of the pairs of engagement features (70A, 72A; 70B, 72B; and 70C, 72C) disposed along the first and second uprights 54, 56 of the trim breaker 40. As further shown in FIG. 8A, the bin assembly 46 includes a stepped configuration 172 disposed at the intersection of the rear wall 164 and the sidewall 166. The stepped configuration 172 includes a first portion 172A extending outwardly from the rear wall 164, and a second portion 172B extending inwardly from the sidewall 166. Within the stepped configuration 172, an engagement feature 174A is shown in the form of a wedge-shaped member having a downwardly and inwardly angled wedged surface 176A. In use, the engagement feature 174A of the bin assembly 46 is configured to couple to a corresponding engagement feature (70A, 72A; 70B, 72B; and 70C, 72C) of the trim breaker 40.

Figure 8B:
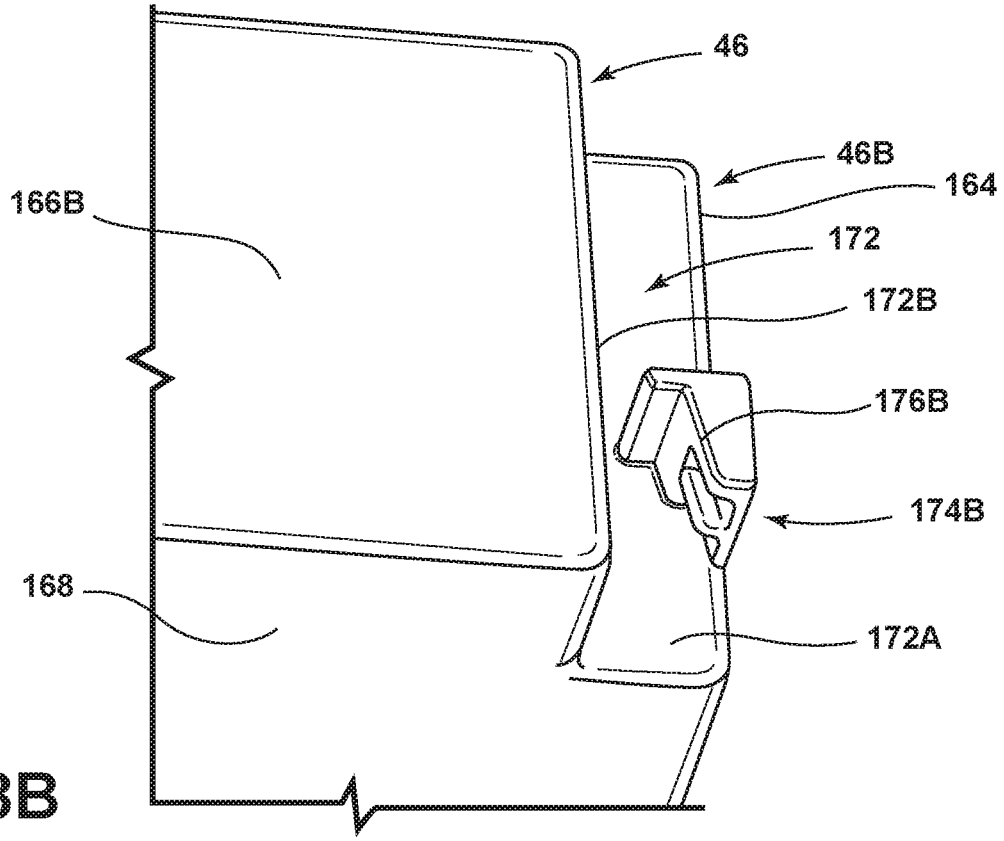
FIG. 8B is a fragmentary bottom perspective view of a second side of the bin assembly of FIG. 8A.

Referring now to FIG. 8B, the second side 46B of the bin assembly 46 is shown having a mirrored configuration relative to the first side 46A of the bin assembly 46 shown in FIG. 8A. As shown in FIG. 8B, the bin assembly 46 includes a stepped configuration 172 disposed at the intersection of the rear wall 164 and the sidewall 166 on the second side 46B of the bin assembly 46. Much like the stepped configuration 172 of the first side 46A of the bin assembly 46, the stepped configuration 172 of the second side 46B of the bin assembly 46 includes a first portion 172A extending outwardly from the rear wall 164, and a second portion 172B extending inwardly from the sidewall 166. Within the stepped configuration 172, an engagement feature 174B is shown in the form of a wedge-shaped member having a downwardly and inwardly angled wedged surface 176B. In use, the engagement feature 174B of the bin assembly 46 is configured to couple to a corresponding engagement feature (70A, 72A; 70B, 72B; and 70C, 72C) of the trim breaker 40.

Figure 9A:
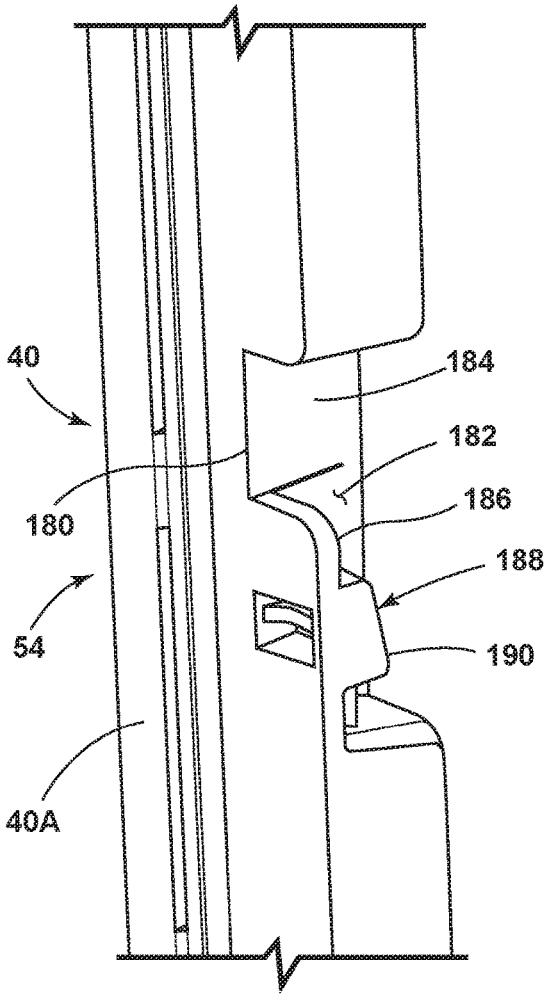
FIG. 9A is a fragmentary front perspective view of an engagement feature disposed on a trim breaker upright.
Figure 9B:
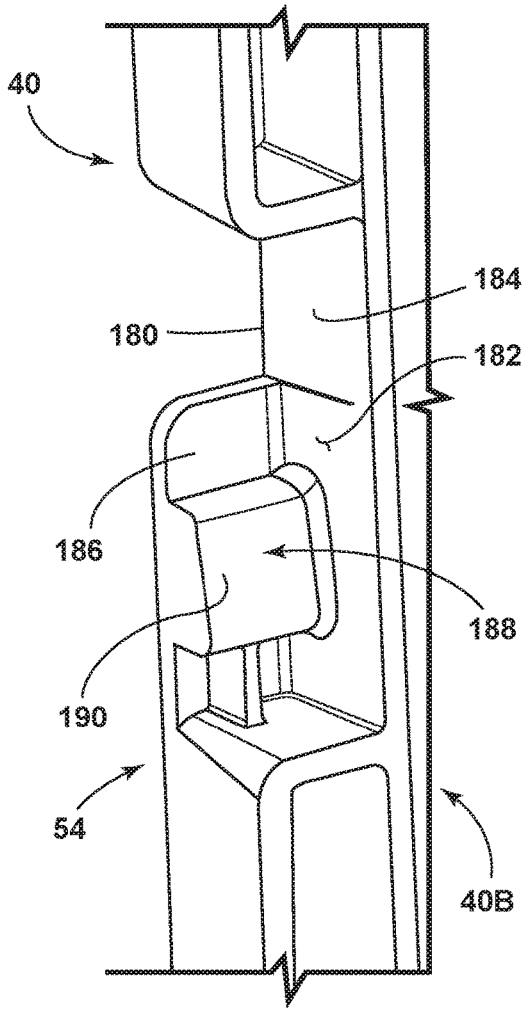
FIG. 9B is a fragmentary rear perspective view of the trim breaker upright of FIG. 9A.

Referring now to FIGS. 9A and 9B, another embodiment of the trim breaker 40 is shown. Specifically, in FIGS. 9A, 9B, a portion of the first upright 54 of the trim breaker 40 is shown having an aperture 180 disposed through the front surface 40A of the trim breaker 40. The aperture 180 opens into a cavity 182 which is defined by first and second sidewalls 184, 186. Extending outwardly from sidewall 186 and into cavity 182, a wedge-shaped engagement feature 188 is shown having a downwardly and outwardly angled wedged surface 190. The configuration of the downwardly and outwardly angled wedged surface 190 is a reciprocal configuration to the downwardly and inwardly angled wedged surface 176A of the first side 46A of the bin assembly 46, and vice versa. As such, the engagement feature 174A of the first side 46A of the bin assembly 46 is configured to engage the engagement feature 188 of the first upright 54 of the trim breaker 40 to releasably couple the first side 46A of the bin assembly 46 to the trim breaker 40. It is further contemplated that the second upright 56 of the trim breaker 40 will include a similar engagement feature as shown in FIGS. 9A, 9B for coupling the second side 46B of the bin assembly 46 to the trim breaker 40 to interconnect the first and second upright members 54, 56.

Figure 10B:
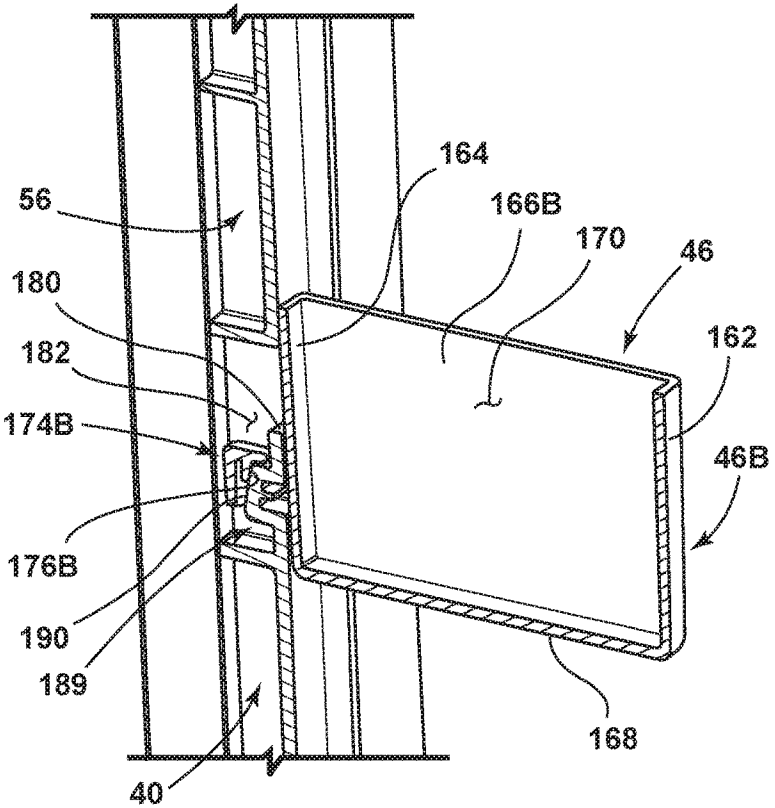
FIG. 10B is a cross-sectional view of the bin assembly of FIG. 10A engaged with the engagement feature of FIG. 10A.
Figure 10A:
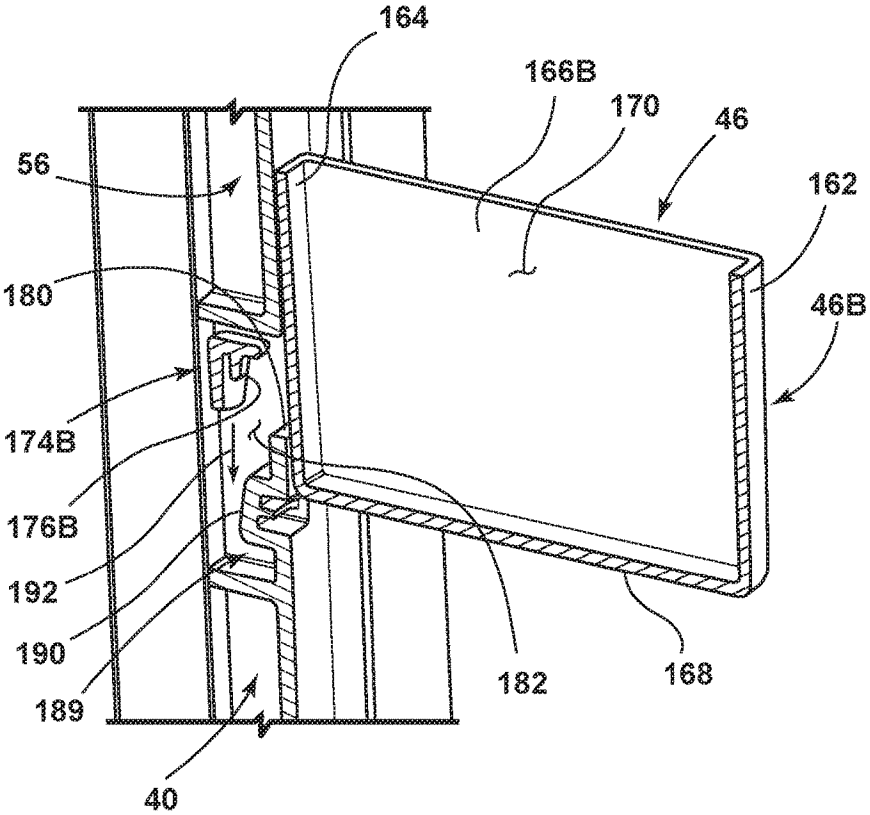
FIG. 10A is a cross-sectional view of the bin assembly of FIG. 8A positioned to engage the engagement feature of FIG. 9A.
Figure 10D:
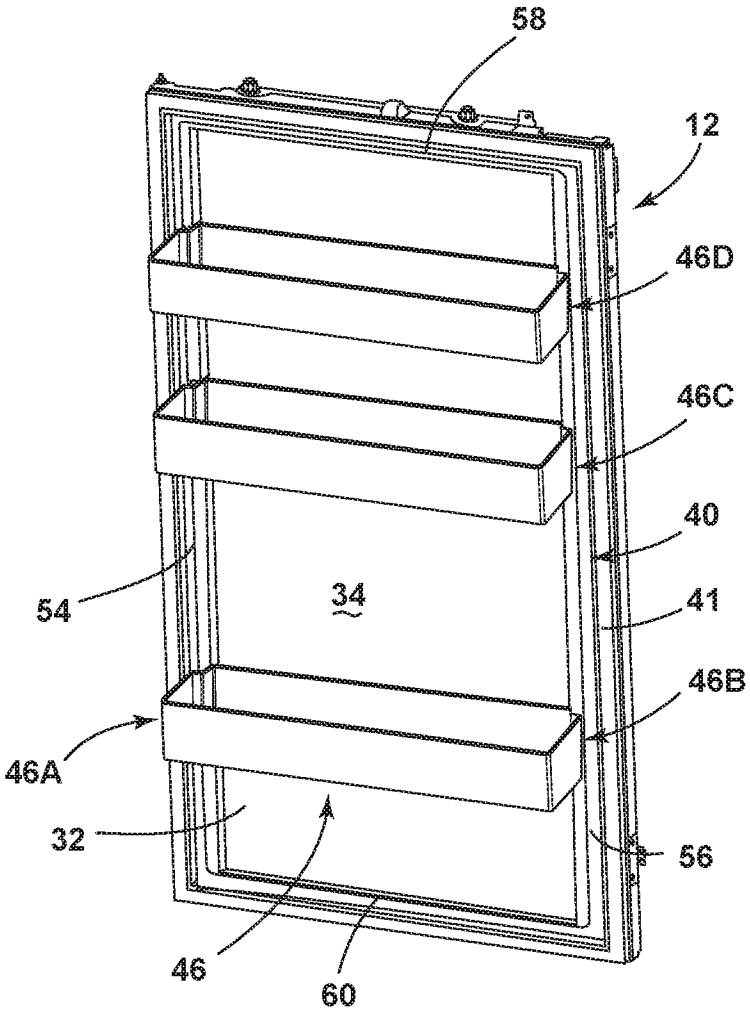
FIG. 10D is a front perspective view of the door panel of FIG. 10C having multiple bin assemblies mounted thereto.
Figure 10C:
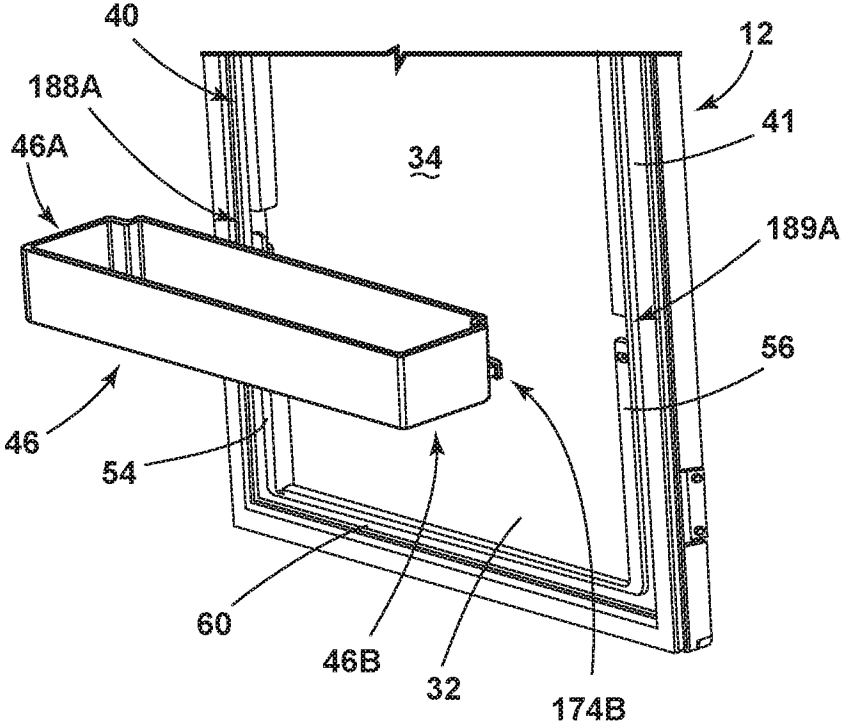
FIG. 10C is a front perspective view of a door panel having a bin assembly exploded away therefrom.

Referring now to FIG. 10A, the bin assembly 46 is shown in a cross-sectional view having engagement feature 174B extending off from rear wall 164. The bin assembly 46 is configured in FIG. 10A to couple to the engagement feature 189 of the trim breaker 40. Engagement feature 189 of the trim breaker 40 is configured in a mirrored configuration relative to engagement feature 188 described above, having all the same features as engagement feature 188 described herein using similar reference numerals. In FIG. 10, the engagement feature 174B of the bin assembly 46 has been received through aperture 180 and is disposed within cavity 182 of the second upright 56 of the trim breaker 40. The wedged surface 176B of the engagement feature 174B of the bin assembly 46 is disposed over the wedged surface 190 of the engagement feature 189 of the trim breaker 40. With the engagement feature 174B of the bin assembly 46 received through aperture 180 of the trim breaker 40, the bin assembly 46 need only moved downward in a direction as indicated by arrow 192, such that the engagement feature 174B of the bin assembly 46 can engage the engagement feature 189 of the trim breaker 40. This engagement of the second side 46B of the bin assembly 46 to the second upright 56 of the trim breaker 40 is shown in FIG. 10B. As specifically shown in FIG. 10B, the wedged surface 176B of the engagement feature 174B of the bin assembly 46 is wedgingly engaged with the wedged surface 190 of engagement feature 189 of the trim breaker 40. Reciprocal engagement features, such as engagement feature 174A, disposed on the first side 46A (FIG. 8A) of the bin assembly 46 are similarly engaged with the first upright 54 of the trim breaker 40 as shown in FIGS. 10C and 10D. In this way, the bin assembly 46 is securely mounted to the trim breaker 40 at a desired vertical position along the trim breaker 40.

Figure 11B:
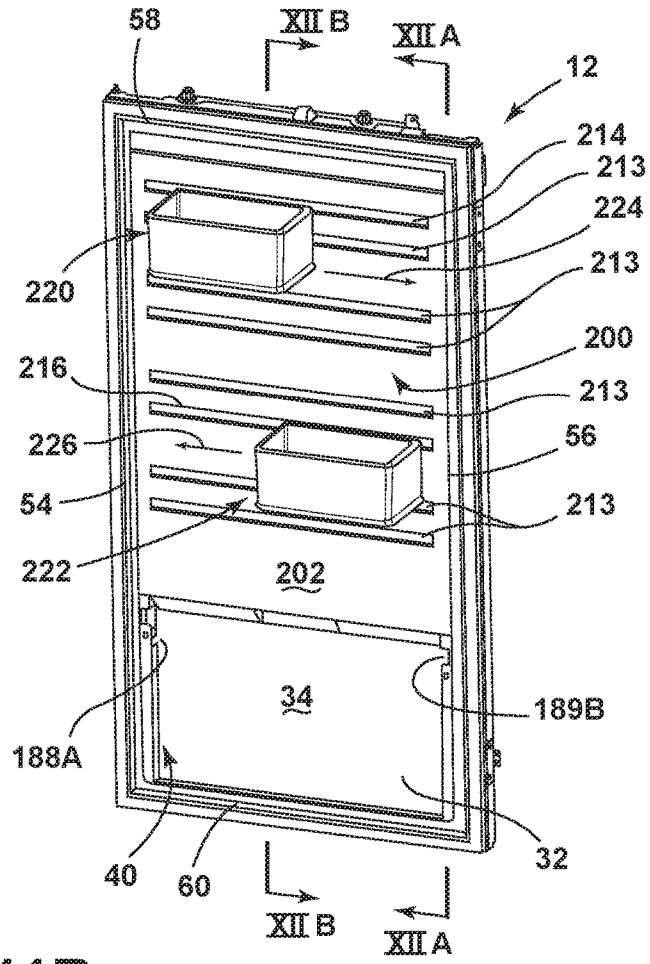
FIG. 11B is a front perspective view of the door panel of FIG. 11A with the bracket system mounted thereto and the bin assemblies slidably coupled to the bracket system.
Figure 11A:
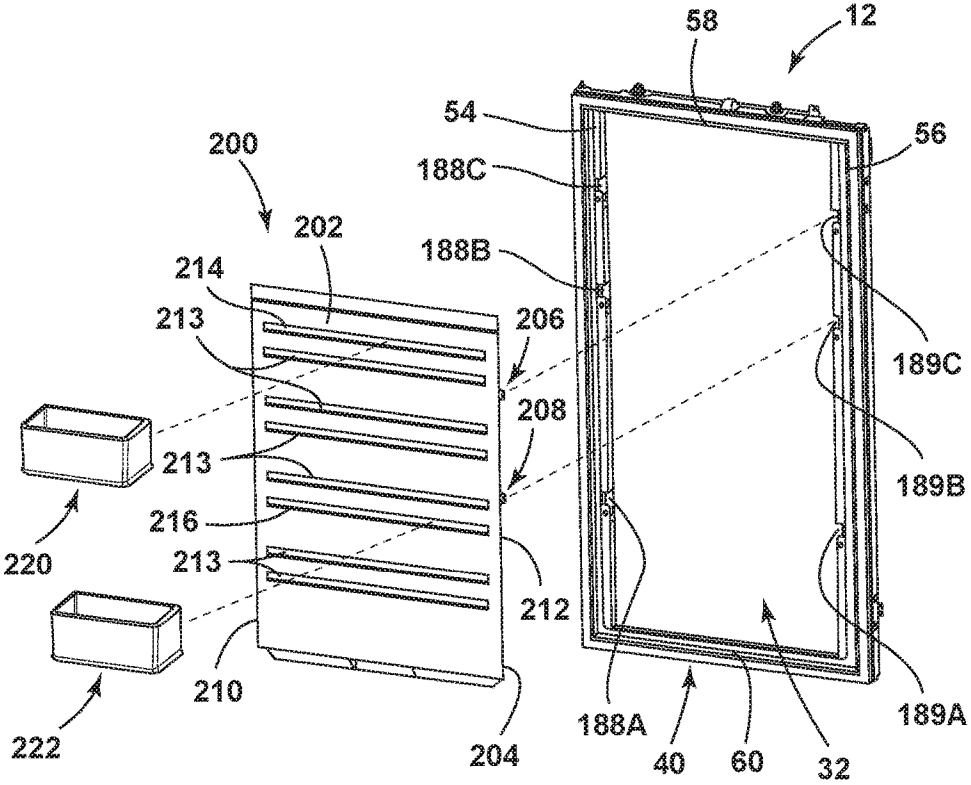
FIG. 11A is a front perspective view of a door panel having a bracket system and bin assemblies exploded away therefrom.

Referring now to FIG. 10C, the bin assembly 46 is shown exploded away from the door panel 12. The door panel includes trim breaker 40 having aligned engagement features 188A, 189A disposed on the first and second uprights 54, 56, respectively. The engagement features 188A and 189A are configured in an identical configuration relative to engagement features 188 and 189, respectively, described above. With reference to FIG. 11A, the trim breaker 40 further includes engagement features 188B, 188C which align with engagement features 189B, 189C, respectively, which also mirror the engagement features 188, 189 described above. It is contemplated that the same trim breaker 40 is shown in FIGS. 10C and 11A. As further shown in FIG. 10C, the bin assembly 46 includes first and second sides 46A, 46B, which each include an engagement feature as described above. Engagement feature 174B is shown extending from the second side 46B of the bin assembly 46 for engagement with engagement feature 189A of the trim breaker 40. It is contemplated that engagement feature 174A (FIG. 8A) of the bin assembly 46 extends rearwardly from the first side 46A of the bin assembly 46 for coupling to engagement feature 188A of the trim breaker 40.

Referring now to FIG. 10D, bin assembly 46 is shown mounted to the trim breaker 40 at a lower portion of the trim breaker 40. Bin assemblies 46C, 46D are shown mounted to the trim breaker 40 at higher vertical positions relative to the mounting of bin assembly 46. As mounted to the trim breaker 40, the bin assemblies 46, 46C, 46D hide the associated engagement features, such as engagement features 188A-188C, 189A-189C, of the trim breaker 40 to provide a clean aesthetic. As shown in FIG. 10D, the bin assemblies 46, 46C, 46D span between the first and second uprights 54, 56 of the trim breaker 40 to interconnect the same.

Referring now to FIG. 11A, a door panel 12 is shown having the trim breaker 40 of FIGS. 9A and 9B disposed thereon. In the embodiment shown in FIG. 11A, the trim breaker 40 includes engagement features 188A, 188B and 188C disposed along upright 54. Reciprocal engagement features 189A, 189B and 189C are disposed along upright 56 of the trim breaker 40. In this way the engagement features 188A, 188B and 188C disposed along upright 54 are aligned with the engagement features 189A, 189B and 189C are disposed along upright 56 in a similar manner as described above with reference to engagement features 70A-70C and 72A-72C. The engagement features 188A-188C, 189A-189C of the trim breaker 40 are contemplated to be configured like engagement feature 188 described above with reference to FIGS. 9A-10B.

As further shown in FIG. 11A, a bracket system 200 is shown exploded away from the door panel 12. The bracket system 200 includes an inner surface 202 and outer surface 204. The outer surface 204 includes a plurality of engagement features, of which engagement features 206, 208 are shown. The engagement features 206, 208 of the bracket system 200 are configured in a manner as described above with reference to engagement features 174A, 174B shown on bin assembly 46. In this way, the engagement features 206, 208 of the bracket system are configured to couple to the engagement features 188A-188C, 189A-189C of the trim breaker 40. Specifically, engagement features 206, 208 of the bracket system 200 are configured to engage with engagement features 189C and 189B of the trim breaker 40, respectively. It is contemplated that reciprocal engagement features to engagement features 188C and 188B are disposed on the bracket system 200 to similarly mount the bracket system 200 thereto. In this way, the bracket system 200 mounts to the door panel 12 to substantially cover the inner surface 34 of the inner panel 32, as shown in FIG. 11B. Thus, the trim breaker 40 can support bin assemblies, such as bin assemblies 47A-47C (FIG. 10D), a bracket system, such as bracket system 200 (FIG. 11A), or potentially both using the same engagement features of the trim breaker 40 providing for efficient customization of the door panel 12.

As further shown in FIG. 11A, the bracket system 200 includes a plurality of slots 213 disposed on the inner surface 202 of the bracket system 200. The slots 213 substantially span the inner surface 202 of the bracket system 200 between opposed first and second sides 210, 212 of the bracket system 200. The slots 213 are vertically spaced-apart along the inner surface 202 of the bracket system 200 and are configured to support bin assemblies for sliding lateral movement thereon. As specifically shown in FIG. 11A, bin assemblies 220, 222 are configured to be received on slots 214 and 216 of the bracket system 200. Slots 214 and 216 are contemplated to be similarly configured relative to slots 213, but are specifically identified as slots 214, 216 for purposes of identifying the specific slots upon which the bin assemblies 220, 222 are mounted. It is contemplated herein that the bin assemblies 220, 222 are identically configured, such that the description of one describes the other. However, it is contemplated that the bracket system 200 of the present concept may support bin assemblies having various shapes and sizes.

Referring now to FIG. 11B, the bin assemblies 220, 222 are shown mounted to slots 214, 216 of the bracket system 200, respectively. The bracket system 200 is shown mounted to the first and second uprights 54 and 56 of the trim breaker 40 along the door panel 12. The bin assemblies 220, 222 are configured to move laterally along the slots 214, 216 in the directions as indicated by arrows 224, 226, respectively. Thus, the bin assemblies 220, 222 are slideably mounted on the bracket system 200.

Figure 12C:
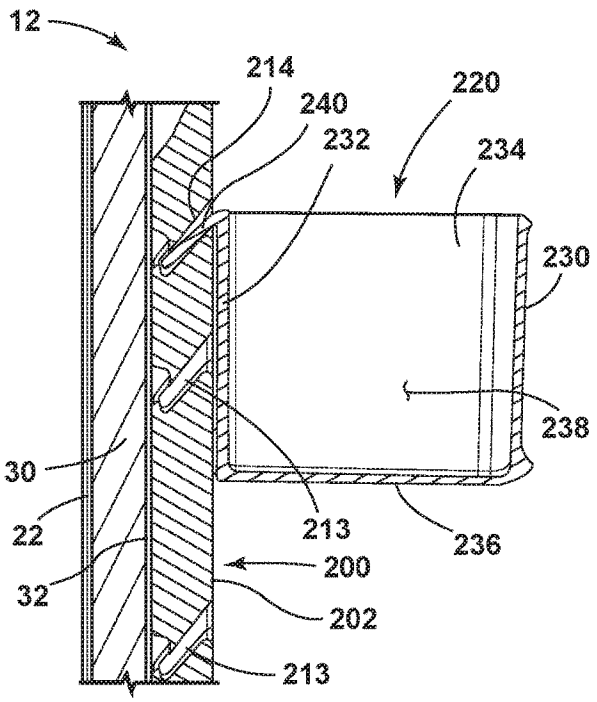
FIG. 12C is a fragmentary view of the door panel of FIG. 12B.
Figure 12B:
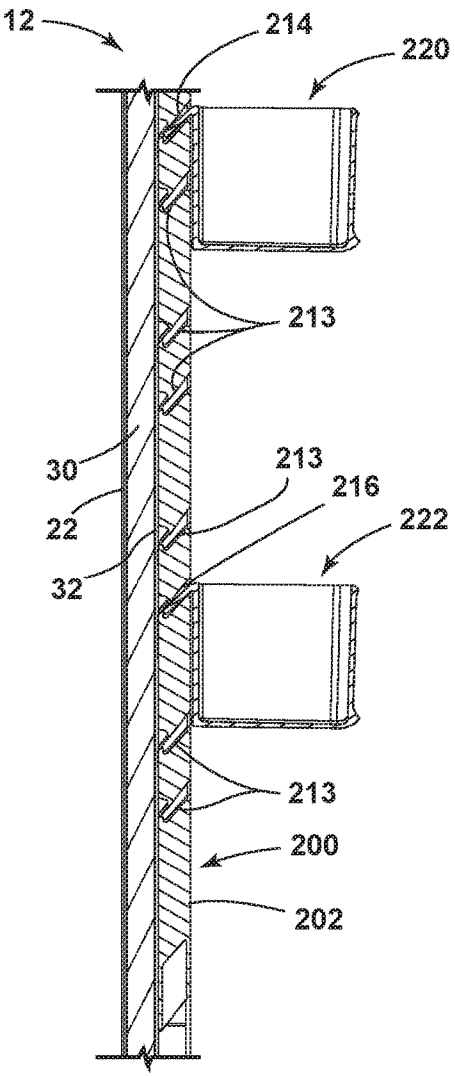
FIG. 12B is a cross-sectional view of the door panel of FIG. 11B taken at line XIIB.
Figure 12A:
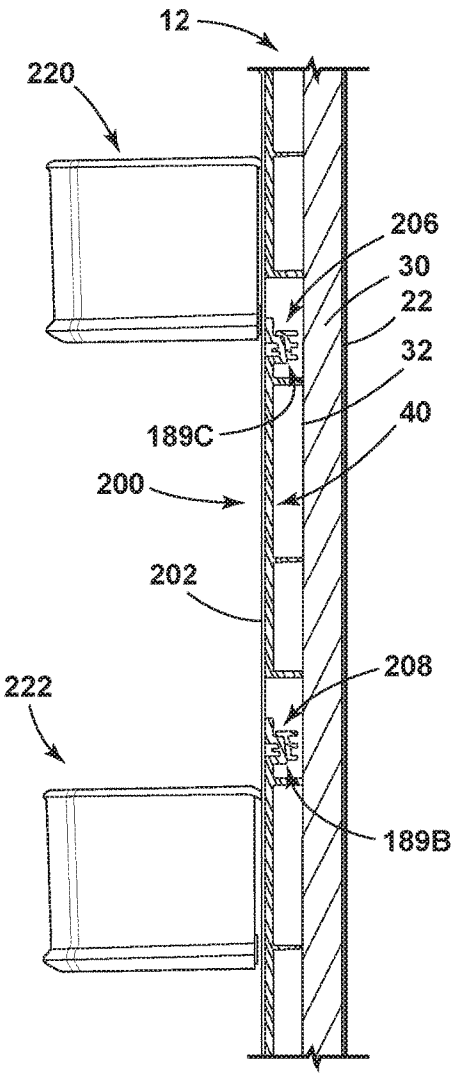
FIG. 12A is a cross-sectional view of the door panel of FIG. 11B taken at line XIIA.

Referring now to FIG. 12A, the bin assemblies 220, 222 are shown mounted to the bracket system 200 and extending outwardly from the inner surface 202 thereof. As specifically shown in FIG. 12A, engagement features 206, 208 of the bracket system 200 are shown coupled to engagement features 189C and 189B of the trim breaker 40.

Referring now to FIG. 12B, the bin assemblies 220, 222 are shown mounted to the bracket system 200 at slots 214, 216 thereof. As shown in FIG. 12B, the slots 213, 214 and 216 of the bracket system 200 inwardly and downwardly extend into the bracket system 200.

Referring now to FIG. 12C, the bin assembly 220 is shown to include a front wall 230, a rear wall 232, sidewall 234, and a bottom wall 236 which cooperate to define a storage compartment 238. Along an upper portion of the rear wall 232, a mounting tab 240 is disposed. The mounting tab 240 extends outwardly and downwardly from the rear wall 232 of the bin assembly 222 for reception within the slot 214 of the bracket system 200. With the mounting tab 240 being outwardly and downwardly disposed, and the slot 214 of the bracket system 200 being inwardly and downwardly disposed, the bin assembly 220 is supported in a cantilevered manner from the inner surface 202 of the bracket system 200. As noted above, the mounting tab 240 is used to slideably mount the bin assembly 220 along the slot 214 for lateral movement along the bracket system 200.

According to at least one aspect, a door panel includes an outer panel having a generally planar body portion with inner and outer surfaces and a sidewall with a front edge. The sidewall of the outer panel inwardly extends from the inner surface of the body portion of the outer panel. An inner panel includes a generally planar body portion with inner and outer surfaces and a sidewall with a front edge. The sidewall of the inner panel inwardly extends from the inner surface of the body portion of the inner panel. A trim breaker interconnects the outer panel and the inner panel to form a vacuum cavity therebetween. The trim breaker includes first and second upright members interconnected by upper and lower cross members. The trim breaker further includes an inner channel and an outer channel spaced-apart from one another around the trim breaker. The outer channel is outwardly disposed around the inner channel. The front edge of the inner panel is received in the inner channel of the trim breaker, and the front edge of the outer panel is received in the outer channel of the trim breaker.

According to another aspect, the first and second upright members of the trim breaker are spaced-apart from one another.

According to another aspect, each of the first and second upright members of the trim breaker include a plurality of engagement features outwardly extending from a front surface of the trim breaker.

According to another aspect, each engagement feature of the plurality of engagement features includes an outwardly extending tab having an aperture disposed therethrough with a cavity extending downwardly from an undersurface of the tab.

According to another aspect, one or more bin assemblies having opposed first and second sides, wherein the one or more bin assemblies are removeably supported on the plurality of engagement features of the first and second upright members of the trim breaker to interconnect the first and second upright members of the trim breaker at the opposed first and second sides of the one or more bin assemblies, respectively.

According to yet another aspect, the inner panel and the outer panel are comprised of a metal material.

According to another aspect, the trim breaker is comprised of a polymeric material.

According to yet another aspect, the vacuum cavity includes an air pressure level of less than 1 atm.

According to at least another aspect, a door panel includes an outer panel having a body portion with a sidewall that extends inwardly from the body portion of the outer panel. An inner panel includes a body portion with a sidewall that extends inwardly from the body portion of the inner panel. A trim breaker interconnects the outer panel and the inner panel to form a vacuum cavity therebetween. The trim breaker includes a frame assembly that surrounds an open window, and further includes an inner channel and an outer channel spaced-apart from one another around the frame assembly of the trim breaker. A portion of the sidewall of the inner panel is received in the inner channel of the trim breaker, and a portion of the sidewall of the outer panel is received in the outer channel of the trim breaker.

According to another aspect, the inner channel includes first and second sidewalls interconnected by an end wall to define a U-shaped configuration.

According to another aspect, a centering feature extending inwardly into the inner channel from one of the first and second sidewalls or a combination thereof.

According to another aspect, the outer channel includes first and second sidewalls interconnected by an end wall to define a U-shaped configuration.

According to another aspect, a centering feature extending inwardly into the outer channel from one of the first and second sidewalls of the outer channel or a combination thereof.

According to another aspect, the inner panel and outer panel are comprised of a metal material.

According to another aspect, the trim breaker is comprised of a polymeric material.

According to yet another aspect, the vacuum cavity includes an air pressure level of less than 1 atm.

According at least another aspect, a door panel includes an outer panel having a body portion with a sidewall that extends inwardly from the body portion of the outer panel. An inner panel includes a body portion with a sidewall that extends inwardly from the body portion of the inner panel. A trim breaker interconnects the outer panel and the inner panel to form a vacuum cavity therebetween. The trim breaker includes first and second upright members interconnected by upper and lower cross members, and further includes an inner channel and an outer channel spaced-apart from one another. A portion of the sidewall of the inner panel is received in the inner channel of the trim breaker, and a portion of the sidewall of the outer panel is received in the outer channel of the trim breaker. Each of the first and second upright members further include a plurality of engagement features disposed along an inside surface of the trim breaker.

According to another aspect, a bracket system having opposed first and second sides, wherein the bracket system is removeably supported on one or more of the engagement features of the plurality of engagement features of the first and second upright members of the trim breaker to interconnect the first and second upright members of the trim breaker at the opposed first and second sides of the bracket system, respectively.

According to another aspect, the bracket system includes a plurality of slots vertically spaced-apart from one another and disposed between the opposed first and second sides thereof.

According to yet another aspect, one or more bin assemblies having mounting tabs outwardly extending therefrom, wherein each mounting tab is configured to be received within a slot of the plurality of slots of the bracket system to slidably mount the one or more bin assemblies to the bracket system.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A door panel, comprising:

an outer panel having a generally planar body portion with inner and outer surfaces and a sidewall with a front edge, the sidewall of the outer panel inwardly extending from the inner surface of the body portion of the outer panel;

an inner panel having a generally planar body portion with inner and outer surfaces and a sidewall with a front edge, the sidewall of the inner panel inwardly extending from the inner surface of the body portion of the inner panel; and a trim breaker interconnecting the outer panel and the inner panel to form a vacuum cavity therebetween, the trim breaker including first and second upright members spaced-apart from one another and directly interconnected by upper and lower cross members, wherein each of the first and second upright members of the trim breaker includes a plurality of engagement features outwardly extending from a front surface of the trim breaker, wherein each engagement feature of the plurality of engagement features includes an outwardly extending tab having an aperture disposed therethrough with a cavity extending downwardly from an undersurface of the tab, wherein the trim breaker further includes an inner channel and an outer channel spaced-apart from one another and continuously disposed along the first and second upright members and the upper and lower cross members, wherein the outer channel is outwardly disposed around the inner channel, wherein the front edge of the inner panel is received in the inner channel of the trim breaker, and further wherein the front edge of the outer panel is received in the outer channel of the trim breaker.

2. The door panel of claim 1, including:

one or more bin assemblies having opposed first and second sides, wherein the one or more bin assemblies are removeably supported on the plurality of engagement features of the first and second upright members of the trim breaker to interconnect the first and second upright members of the trim breaker at the opposed first and second sides of the one or more bin assemblies, respectively.

3. The door panel of claim 1, wherein the inner panel and the outer panel are comprised of a metal material.

4. The door panel of claim 3, wherein the trim breaker is comprised of a polymeric material.

5. The door panel of claim 4, wherein the vacuum cavity includes an air pressure level of less than 1 atm.

6. The door panel of claim 1, wherein the inner channel includes first and second sidewalls interconnected by an end wall to define a U-shaped configuration.

7. The door panel of claim 6, including:

a centering feature extending inwardly into the inner channel from one of the first and second sidewalls or a combination thereof.

8. The door panel of claim 7, wherein the outer channel includes first and second sidewalls interconnected by an end wall to define a U-shaped configuration.

9. The door panel of claim 8, including:

a centering feature extending inwardly into the outer channel from one of the first and second sidewalls of the outer channel or a combination thereof.

10. A door panel, comprising:

an outer panel having a body portion with a sidewall extending inwardly away from the body portion of the outer panel;

an inner panel having a body portion with a sidewall extending inwardly away from the body portion of the inner panel;

a trim breaker interconnecting the outer panel and the inner panel to form a vacuum cavity therebetween, the trim breaker including first and second upright members disposed in a vertical direction and spaced-apart from one another, wherein the first and second upright members are directly interconnected by upper and lower cross members that are disposed in a horizontal direction that is substantially perpendicular to the first and second upright members, wherein the trim breaker further includes an inner channel and an outer channel spaced-apart from one another, wherein a portion of the sidewall of the inner panel is received in the inner channel of the trim breaker and a portion of the sidewall of the outer panel is received in the outer channel of the trim breaker, wherein each of the first and second upright members further include a plurality of engagement features disposed along an inside surface of the trim breaker; and a bracket system having opposed first and second sides, wherein the bracket system is removably supported on one or more of the engagement features of the plurality of engagement features of the first and second upright members of the trim breaker to interconnect the first and second upright members of the trim breaker at the opposed first and second sides of the bracket system, respectively.

11. The door panel of claim 10, wherein the bracket system includes a plurality of slots vertically spaced-apart from one another and disposed between the opposed first and second sides thereof.

12. The door panel of claim 11, including:

one or more bin assemblies having mounting tabs outwardly extending therefrom, wherein each mounting tab is configured to be received within a slot of the plurality of slots of the bracket system to slidably mount the one or more bin assemblies to the bracket system.

* * * * *